US006213523B1

(12) United States Patent
Magnusson

(10) Patent No.: US 6,213,523 B1
(45) Date of Patent: Apr. 10, 2001

(54) LOCK

(76) Inventor: Claes Magnusson, 23 McKay Rd., Wimbledon, SW20 OHT London (GB)

( * ) Notice: Subject to any disclaimer, the term of this patent is extended or adjusted under 35 U.S.C. 154(b) by 0 days.

(21) Appl. No.: 09/346,544

(22) Filed: Jul. 2, 1999

(51) Int. Cl.[7] ..... E05C 1/12
(52) U.S. Cl. ..... 292/165; 292/DIG. 64
(58) Field of Search ..... 292/163, 169, 292/169.14, 169.15, 169.18, DIG. 64; 70/468, 488

(56) References Cited

U.S. PATENT DOCUMENTS 2,295,435 9/1942 Teich .
2,727,773 * 11/1955 Hagstrom ..... 292/169.19
4,143,529 * 3/1979 Brummett ..... 70/152
4,296,956 * 10/1981 Colombo ..... 292/169.18
4,297,862 11/1981 Solovieff .
4,974,883 * 12/1990 Jans ..... 292/169
5,141,268 * 8/1992 Keller ..... 292/150
5,474,348 * 12/1995 Palmer ..... 292/339
5,779,287 7/1998 Johansson ..... 292/169.14

FOREIGN PATENT DOCUMENTS

0364781 A2 4/1990 (EP) .

* cited by examiner

*Primary Examiner*—Gary W. Estremsky

(57) ABSTRACT

A lock has a holding bolt and a retaining member for yieldably retaining the holding bolt in its bolting and its release position and for positively preventing the bolt from withdrawal from the lock unless a fastening member attaching a forend of the lock to the lock case is at least partly released.

10 Claims, 4 Drawing Sheets

LOCK

BACKGROUND OF THE INVENTION

1. Field of the Invention

The present invention concerns a lock having a bolting means for bolting a latch bolt.

2. Description of the Background Art

More precisely, this invention concerns a lock installable in, e.g., a door leaf. The lock includes a case and a latch bolt movable within the case between a locking position, in which the latch bolt at least partly projects from the case, and an unlocking position, in which the latch bolt is retracted within the case. Generally, a lock of this kind includes some kind of bolting means adapted to bolt the latch bolt in at least its locked position. Such bolting means is generally factory mounted on one side of the case for access from a corresponding side of a door. Consequently, to comply with possible customer needs, it is necessary to manufacture two locks having the bolting means on opposite sides of the case.

U.S. Pat. No. 5,779,287 discloses a lock having an optional bolting means, i.e., a bolting means that is separately delivered with the lock and that may be mounted in the lock by the user at need. This prior art lock includes a lock case having opposed walls and a latch bolt slidable between a locking position and an unlocking position. Each of the opposed walls is provided with an aperture for optionally receiving a holding bolt. The holding bolt is positionable in each aperture in a first, relatively retracted position allowing sliding of the latch bolt from its locking position to its unlocking position, and in a second relatively inserted position preventing sliding of the holding bolt from its locking position to its unlocking position. The optional bolting means further includes a spring for yieldably retaining the holding bolt in its first and second positions. The apertures are shaped such that once the holding bolt has been introduced in a selected aperture, it is automatically kept there by the spring pressing it towards a portion of the aperture preventing its withdrawal. However, withdrawal of the holding bolt is possible upon manually rotating it through a small, limited angle against the action of the spring. Since the free end of the holding bolt of this prior art lock needs to be axially and radially guided, the lock requires a relatively thick door leaf and particularly an escutcheon mounted onto the door leaf to guide the holding bolt and also to prevent its rotation and unintentional removal.

OBJECT OF THE INVENTION

A first object of the present invention is to provide a lock of the general kind stated preventing unintentional removal and allowing intentional removal of the holding bolt without rotational movement thereof. A second object is to provide such a lock needing neither a relatively thick door leaf nor an escutcheon to guide its holding bolt.

SUMMARY OF THE INVENTION

The first object stated above has been achieved in a lock including a lock case, a forend attachable to said case by means of removable fastening means, a latch bolt movable within said case between a locking position, in which it at least partly projects from the case, and an unlocking position, in which it is retracted within the case, a holding bolt having a defined cross section and being positionable in a first, relatively retracted position allowing movement of said latch bolt from its locking position to its unlocking position, and in a second relatively inserted position preventing movement of said holding bolt from its locking position to its unlocking position, and spring means for yieldably retaining said holding bolt in its first and second positions and for positively preventing withdrawal thereof from said case, wherein at least one portion of said spring means is movable between a first position, in which it prevents withdrawal of said holding bolt, and a second position, in which it allows withdrawal of said holding bolt, movement of said at least one portion from said first to said second position being enabled by at least partial removal of said fastening means.

The second object has been achieved in that said case accommodates a guide means having a guide aperture for guiding movement of said holding bolt, said guide aperture having a cross section adapted to said defined cross section, said at least one portion of said spring means extending across at least a portion of said aperture in said first portion of said spring means.

BRIEF DESCRIPTION OF THE DRAWINGS

Further objects and advantages of the invention will be apparent from the following non-limiting description of a preferred embodiment, reference being made to the annexed drawings, wherein.

DETAILED DESCRIPTION OF A PREFERRED EMBODIMENT

Figure 1:
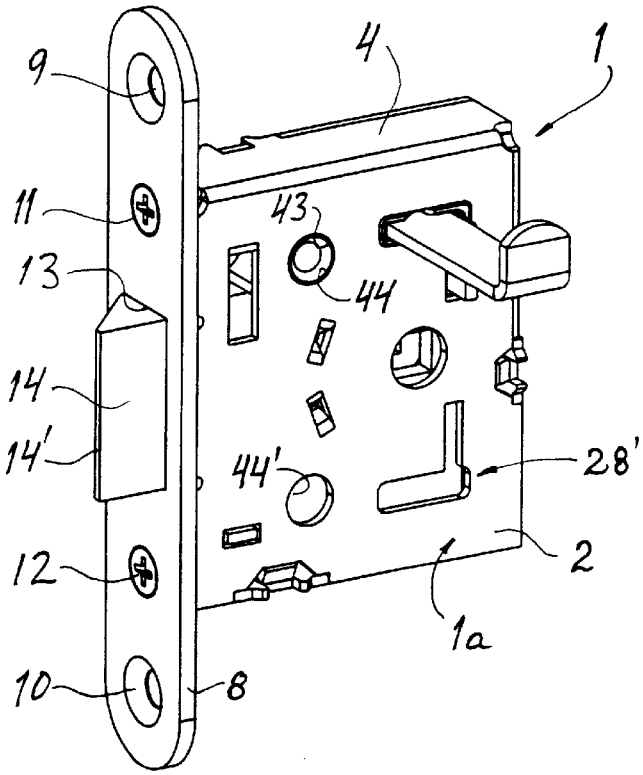
FIG. 1 is a perspective side view of the lock having a holding bolt mounted therein.
Figure 2:
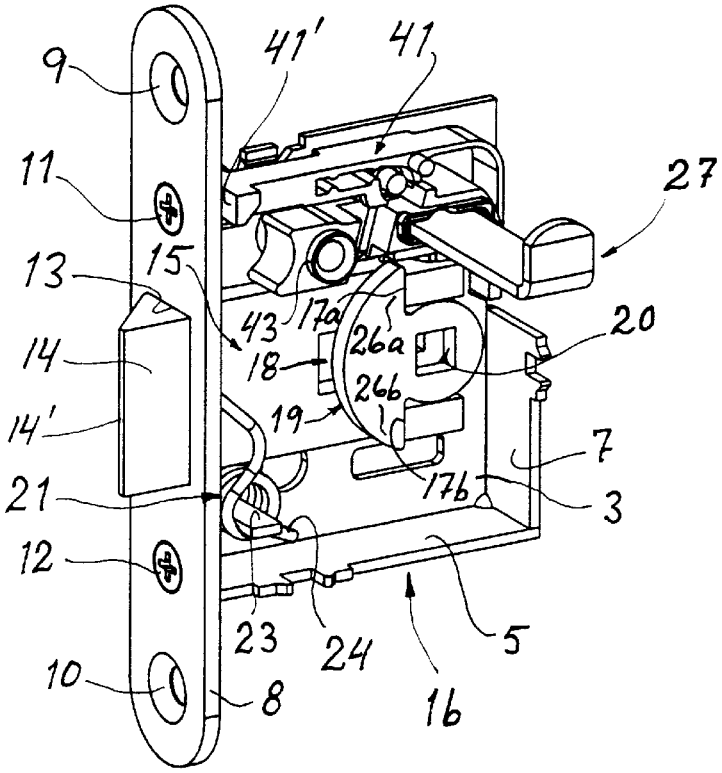
FIG. 2 is a corresponding perspective view showing the lock of FIG. 1 having one half of the lock case removed.
Figure 3:
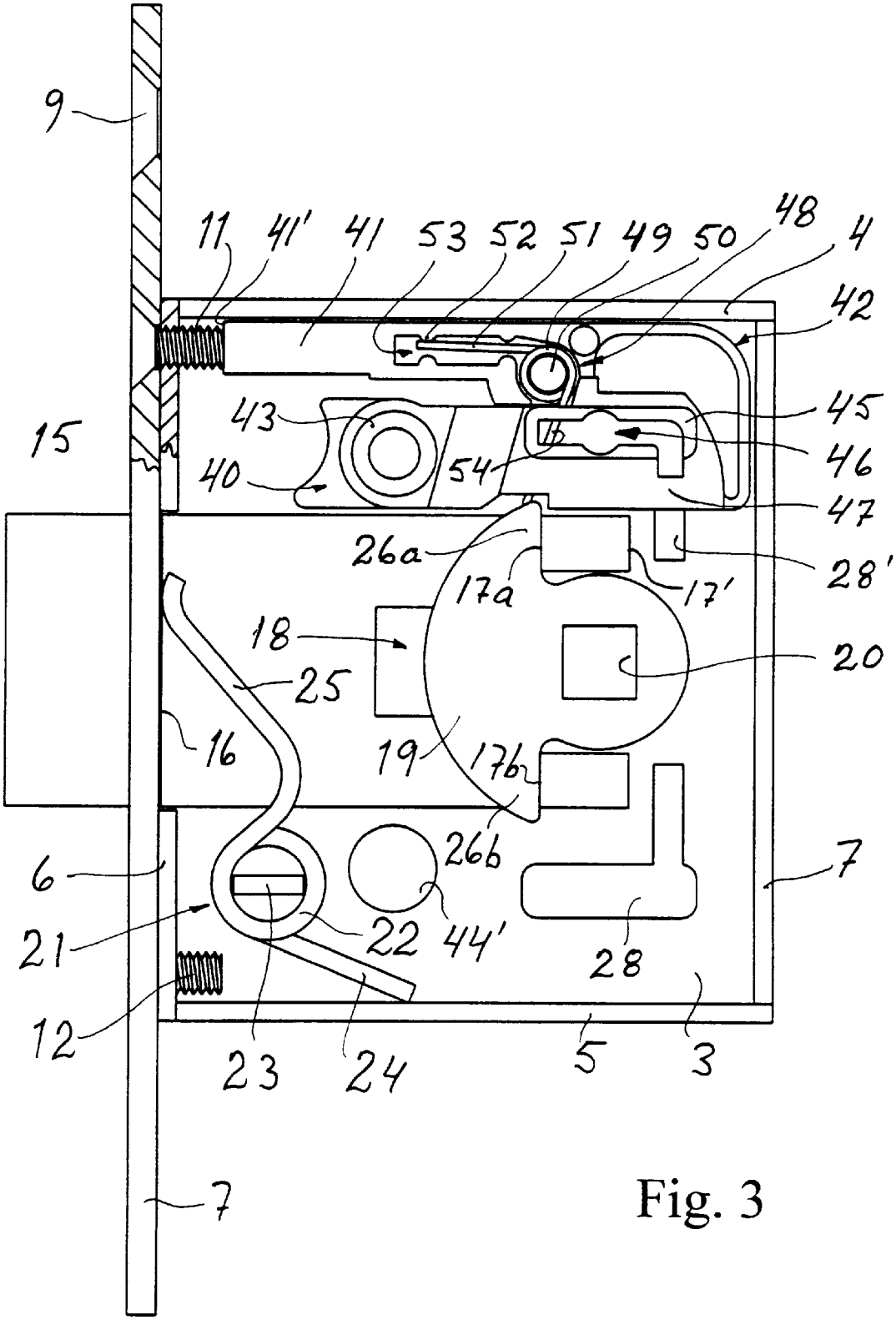
FIG. 3 is a partly sectioned side view at an enlarged scale showing the lock having the holding bolt removed and further showing the holding bolt retaining means in an active position.

The lock according to the present invention has a lock case 1 consisting of two equal halves 1*a*, 1*b*. The case includes two opposed side walls 2 and 3, an upper wall 4, a lower wall 5, a front wall 6 and a back wall 7. A forend 8 has two holes 9 and 10 for attachment of the lock to, e.g., a door leaf. Two screws 11 and 12 attach the forend to the front wall 6. The forend also has a rectangular opening 13 through which a latch bolt 14 is slidable between a foremost, locking position, in which it projects from the case, as seen in FIGS. 1, 2 and 3, and a non-shown, unlocking position, in which it is backwardly retracted within the case so as to leave its front edge 14' substantially flush with the forend 8. The latch bolt has a recessed portion 15 forwardly defined by a shoulder 16 (FIG. 3). In the backward direction a corresponding shoulder is divided in two shoulders 17*a*, 17*b* separated by a slot 18 extending from the backward end of the latch bolt about half way to its forward end.

The latch bolt is operable by means of a follower 19 having a square hole 20 intended for insertion therein of a square rod connected to a handle for rotating the follower through a limited angle. A helical spring 21 having its coil 22 positioned about a lug 23 bent in from the side wall 3 has a first straight end portion 24 bearing on the inner side of the lower wall 5 and a second straight end portion 25 bearing on the shoulder 16 of the latch bolt, so as to urge the latter towards its locking position shown in FIGS. 1, 2 and 3. As appears particularly from FIG. 3, the follower 19 is of the kind having two aligned wings 26*a,* 26*b* abutting a respective one of the shoulders 17*a,* 17*b.* This known arrangement ensures that a handle associated to the follower 19 may operate the latch bolt in both rotational directions of the follower against counteracting forces of the spring 21.

Figure 6:
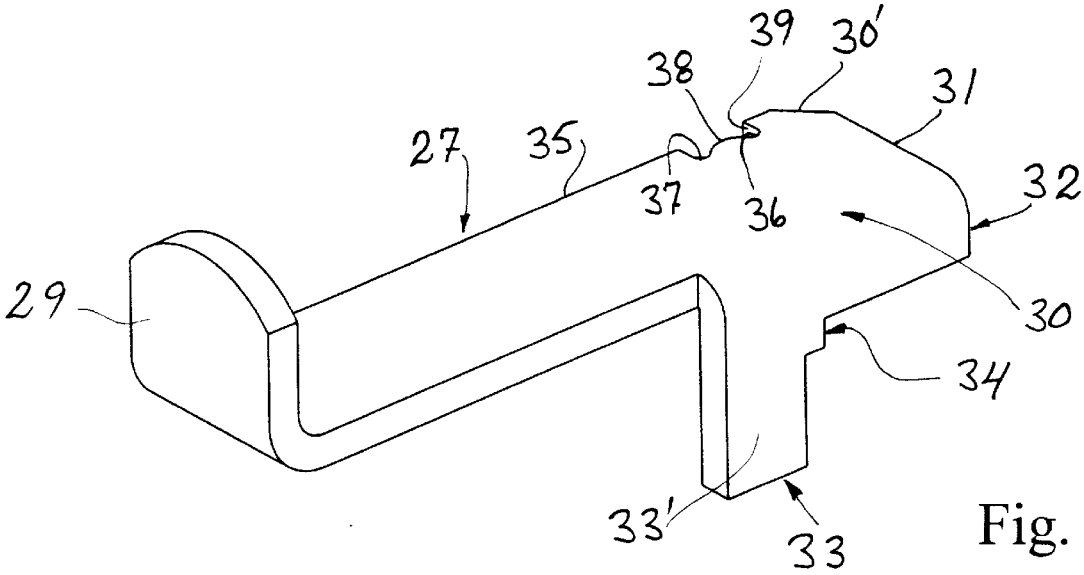
FIG. 6 is a perspective view at an enlarged scale of the holding bolt shown in FIGS. 1 and 2.

In order to bolt the latch bolt so as to prevent movement thereof towards its open position there is provided a bolting means comprising a holding bolt 27 (FIG. 6). The holding bolt is insertable through an L-shaped aperture 28 in wall 2 (FIG. 1) so as to at least partly extend through a corresponding aperture 28' in wall 3 (FIG. 3). In its inserted state, the holding bolt is moveable between a relatively retracted, unbolting position and a relatively inserted, bolting position. The holding bolt 27 includes a straight, flat main portion having in one end a handle portion 29 and in its opposite, inner, or foremost end a guide portion 30 having an L-shaped cross section with a longer leg 31 (corresponding to the main portion) and a shorter leg 32. The portion 30 includes a bolting member 33 extending past the main part of the shorter leg 32. In the bolting position of the holding bolt, this bolting member is positioned in the path of movement of a rear surface 17' of the latch bolt 14 so as to prevent movement thereof towards its unlocking position. The bolting member 33 also provides an abutment shoulder 34. At the inner or forward end of the bolt there are provided in an edge 35 of the main portion a ratchet retaining means including a first and a second recess 36 and 37 separated by a smoothly curved ridge 38, and a positive retaining means comprising a shoulder 39 being substantially perpendicular to the edge 35.

Figure 5:
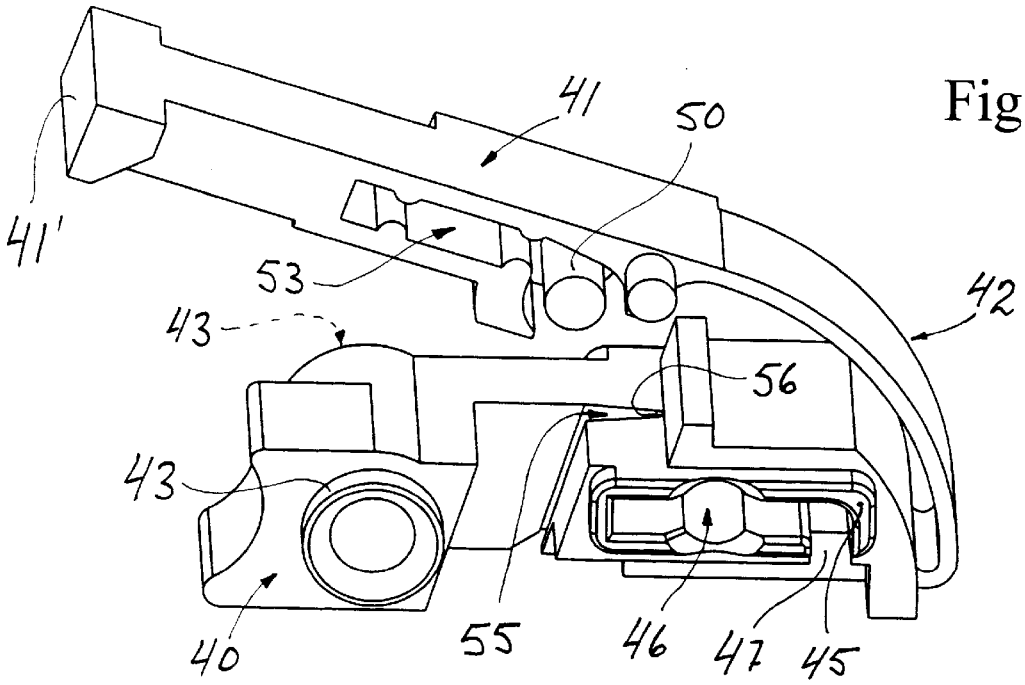
FIG. 5 is a perspective view at an enlarged scale of a guide and ratchet member for the holding bolt.

In order to guide movement of the holding bolt and to yieldably retain it in its unlocking and locking positions, there is provided a guide and ratchet member shown separately in FIG. 5. This member is an integral structure, preferably made of a synthetic resin, including a stationary portion 40 and a movable leg portion 41 joined to the stationary portion by a resilient portion 42. Portion 40 is kept stationary relative to the lock case by means of opposed circular bosses 43 fitting in corresponding bores 44, 44' in the lock case walls 2 and 3, respectively, and likewise opposed protrusions 45 fitting in the L-shaped apertures 28, 28', respectively. A guide opening 46 extends through the protrusions 45 and the stationary portion 40 so as to smoothly guide lengthwise movement of the holding bolt. The guide opening has an L-shape conforming to the cross section of the foremost end of the holding bolt, i.e., its longer leg 31 and shorter leg 32, such that the abutment shoulder 34 restricts movement of the holding bolt in a forward direction by abutting an abutment surface 47 of the stationary portion 40, thus defining the bolting position of the holding bolt.

In order to yieldably retain the holding bolt in its unlocking position and its locking position, there is provided a retaining means in the shape of a helical spring 48 (FIG. 3) having its coil 49 positioned about a cylindrical post 50 provided on the moveable portion 41. The spring 48 has a first substantially straight end portion 51 bearing on a wall 52 of a substantially horizontal slot 53 in the leg portion 41. A second substantially straight end portion 54 of the spring extends through a substantially vertical slot 55 (FIGS. 3 and 5) through the leg portion 41 and bears on an inner wall 56 thereof.

As appears from FIG. 3, the screw 11 abuts the free end 41' of the leg portion 41, thus restricting possible movement thereof to the left of FIG. 3. In this position, the resilient portion 42 of the guide and ratchet member, in its relaxed state having a moderately curved shape as shown in FIG. 5, adopts a more sharp bend substantially conforming to the inner corner between case walls 4 and 7. In this position, the leg portion 54 extends through the cross section of the guide opening 46. Now, when inserting the holding bolt 27 in the guide opening 46, a bevelled corner 30' (FIG. 6) of its guide portion 30 encounters the straight end portion 54 of spring 48 and, upon further insertion, presses it to the left until it comes to rest against the edge 35 and slide therealong until it snaps into the foremost recess 36. In this position, which is the unlocking position, withdrawal of the holding bolt is prevented by the shoulder 38 abutting the spring end portion 54. This, in turn, is supported by the walls of the slot 55 so as not to flex in the direction of withdrawal. However, further insertion of the holding bolt is possible due to the smoothly curved ridge 38 forcing the spring end portion 54 to yield outwardly and then snap into the second recess 37. In this position, which is the locking position of the holding bolt, the abutment shoulder 34 contacts the abutment surface 47 provided on the stationary portion 40 of the guide and ratchet member and prevents further insertion into the lock case.

The lock according to the present invention is primarily intended to be delivered to customers without the holding bolt mounted. As appears from the drawings, there are provided in each half 1*a,* 1*b* of the lock case two L-shaped apertures 28, 28' and two bores 44, 44'. This enables the lock to be factory mounted with two guide and ratchet members. If, on the other hand, the lock is delivered with merely one guide and ratchet member as shown, the customer may shift the position of the guide and ratchet member at will.

Once the lock has been inserted into a corresponding recess in a door leaf and fastened to an edge thereof by means of screws through the holes 9, 10, and then the holding bolt has been inserted into the lock as described above, the holding bolt can no longer be retracted beyond the unlocking position, and, consequently, the lock cannot be removed from the door.

Figure 4:
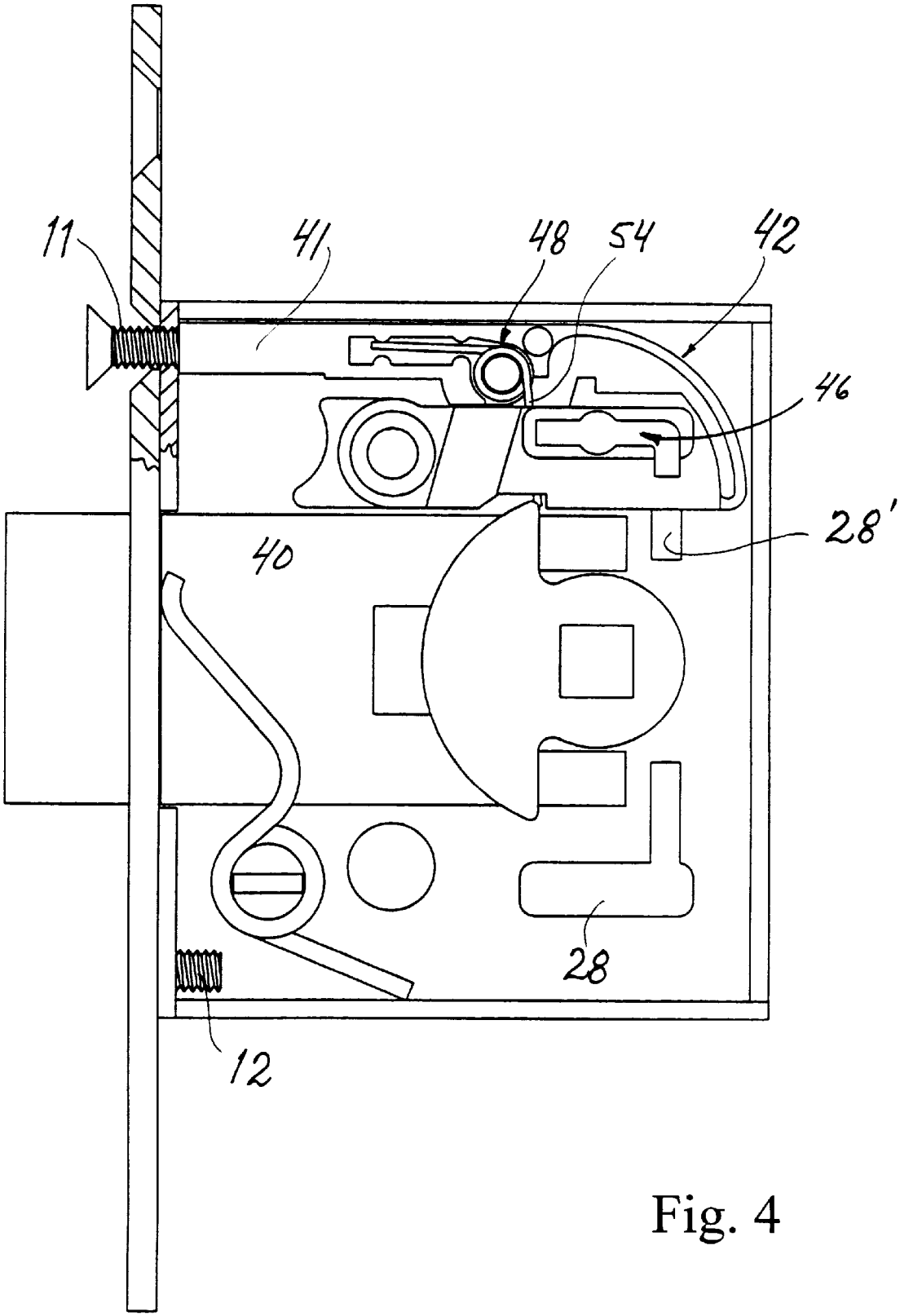
FIG. 4 is a view corresponding to FIG. 3 but showing the holding bolt retaining means in an inactive position.

In order to enable retraction of the holding bolt, and, thus, to enable removal of the lock, the present invention provides for withdrawal of the spring end portion 54 such that it no longer passes the cross section of the aperture 46. This has been achieved by the provision of the movable leg portion 41 of the guide and ratchet member carrying the spring 48 and by its support against the end of screw 11. By simply unthreading the screw 11 as shown in FIG. 4, the movable leg portion carrying the coil 49 of spring 48 will be caused by the spring force of the resilient portion 42 adjoining the movable portion and the stationary portion of the guide and ratchet member to move to the left in FIG. 3. At the end of such movement, the end 41' of the movable portion may come to rest against the inner side of case wall 6 as shown in FIG. 4. In any case, and as likewise shown, the spring end portion 54 has left the cross section of the aperture 28 which, thus, is open for withdrawal of the holding bolt. After wihdrawal of the holding bolt and removal of the lock from its location in a door leaf, the screw 11 may be screwed in again to make the lock ready for renewed mounting, possibly with the holding bolt inserted through an alternate aperture 28.

What is claimed is:

1. A lock comprising:

a lock case;

a forend attached to said lock case by at least one fastening member being removable in an axial direction thereof;

a latch bolt movable within said lock case between a locking position, in which it projects at least partly from said case, and an unlocking position, in which it is retracted within said lock case;

a holding bolt being positionable in a first, relatively retracted position allowing movement of said latch bolt from its locking position to its unlocking position, and in a second relatively inserted position preventing movement of said holding bolt from its locking position to its unlocking position; and spring means for yieldably retaining said holding bolt in its first and second positions and for positively preventing withdrawal thereof form said lock case;

said fastening member is operatively connected to said spring means so that upon at least partial removal of said fastening member in said axial direction at least one portion of said spring means shifts from a first position, defining an abutment means where said holding bolt abuts abut said at least one portion to prevent withdrawal of said holding bolt, to a second position, in which said holding bolt is free for withdrawal from said lock case.

2. The lock according to claim 1, wherein said lock case accommodates a stationary guide member having a guide aperture for guiding movement of said holding bolt, said at least one portion of said spring means extending across at least a portion of said aperture in said first position of said spring means and leaving said aperture free in said second position.

3. The lock according to claim 2, wherein said spring means is carried by a movable member operatively connected to said at least one fastening member.

4. The lock according to claim 3, wherein said fastening member acts on a portion of said movable member facing said fastening member.

5. The lock according to claim 2, wherein said spring means is a helical spring having a coil portion and first and second substantially straight end portions, said coil portion being carried by said movable member, and one of said first and second end portions extending across said guide aperture to positively engage said holding bolt in said first position of said spring means.

6. The lock according to claim 3, wherein said stationary guide member is integral with said moveable member.

7. The lock according to claim 6, wherein said movable member is joined to said stationary member by a resilient portion.

8. The lock according to claim 2, wherein said stationary guide member is provided with protrusions fitting into corresponding apertures in said lock case.

9. The lock according to claim 1, wherein said fastening member is a screw.

10. The lock according to claim 2, wherein said guide aperture is L-shaped and said holding bolt at least partially has an L-shaped cross-section matching said L-shape aperture.

* * * * *